US009021842B2

(12) United States Patent
Rix

(10) Patent No.: US 9,021,842 B2
(45) Date of Patent: May 5, 2015

(54) LOCKABLE UTILITY BOX LID

(71) Applicant: Zachary Daniel Rix, Fresno, CA (US)

(72) Inventor: Zachary Daniel Rix, Fresno, CA (US)

(73) Assignee: Zachary Daniel Rix, Prather, CA (US)

( * ) Notice: Subject to any disclaimer, the term of this patent is extended or adjusted under 35 U.S.C. 154(b) by 0 days.

(21) Appl. No.: 13/681,322

(22) Filed: Nov. 19, 2012

(65) Prior Publication Data

US 2013/0074415 A1 Mar. 28, 2013

Related U.S. Application Data

(63) Continuation of application No. 12/710,363, filed on Feb. 23, 2010, now Pat. No. 8,347,670.

(51) Int. Cl.

| | |
|---|---|
| ***B65D 55/14*** | (2006.01) |
| ***E05B 65/00*** | (2006.01) |
| ***E05B 35/00*** | (2006.01) |
| ***E05B 61/00*** | (2006.01) |

(52) U.S. Cl.

CPC ..... *E05B 65/0089* (2013.01); *E05B 35/008* (2013.01); *E05B 65/006* (2013.01); *E05B 61/00* (2013.01)

(58) Field of Classification Search

USPC ..... 70/163, 164, 166–169, DIG. 34; 220/325, 327; 174/48, 50; 404/25; 52/221

See application file for complete search history.

(56) References Cited

U.S. PATENT DOCUMENTS

| | | | | | |
|---|---|---|---|---|---|
| 589,780 | A * | 9/1897 | Howard | 292/202 |
| 1,384,712 | A * | 7/1921 | Shanley | 404/25 |
| 2,114,499 | A * | 4/1938 | MacLear | 49/465 |
| 3,921,494 | A * | 11/1975 | Coe | 411/344 |
| 5,056,955 | A * | 10/1991 | Spiess et al. | 404/25 |
| 5,071,177 | A * | 12/1991 | Spiess et al. | 292/91 |
| 5,611,640 | A * | 3/1997 | Bowman | 404/4 |
| 6,802,962 | B1 * | 10/2004 | Browne et al. | 210/164 |
| 8,347,670 | B2 * | 1/2013 | Rix | 70/168 |
| 8,585,316 | B2 * | 11/2013 | Taylor | 404/25 |
| 2013/0101347 | A1 * | 4/2013 | Taylor | 404/25 |

* cited by examiner

*Primary Examiner* — Suzanne Barrett

(74) *Attorney, Agent, or Firm* — R. Scott Kimsey, Esq.; Klein DeNatale Goldner

(57) ABSTRACT

A lockable utility box lid includes at least one aperture therethrough for receiving a fastener. The locking mechanism preferably includes a utility box engagement member coupled to the underside of the utility box lid. The locking mechanism is movable between a locked and unlocked position. A fastener extends through the opening in the utility box lid and engages the locking mechanism. Rotating the fastener in a first direction causes the locking mechanism to assume a first, locked position. Rotating the fastener in a second direction causes the locking mechanism to assume a second, unlocked position. In the locked position the utility box engagement member is engaged with an interior surface of the utility box lid.

10 Claims, 8 Drawing Sheets

DETAIL 1C OF FIG. 1B

SECTION 6B-6B
OF FIG.6A

SECTION 6C-6C
OF FIG.6A

SECTION 7B-7B
OF FIG.7A

LOCKABLE UTILITY BOX LID

RELATED APPLICATIONS

This application is a Continuation of U.S. Utility patent application Ser. No. 12/710,363, filed Feb. 23, 2010 and entitled "Lockable Utility Box Lid," which application in turn claims benefit of U.S. Patent Application No. 61/154,425, filed Feb. 22, 2009. Both of the aforementioned applications are incorporated herein by reference in their entireties.

BACKGROUND OF THE INVENTION

1. Field of the Invention

The present invention relates to utility box lids generally, and more specifically to a lockable utility box lid.

2. Background

Conventional utility boxes are used to house various utilities including, but limited not to, electrical, telecommunication, fiber optic, water and other similar utilities and their related appurtenances. Originally, utility box lids were made to rest in place on a recessed lip of the box enclosure over the upward facing opening so that the uppermost surface of the lid and top rim of the enclosure are flush. When installed in conjunction with an underground utility system, these surfaces are generally exposed and intentionally placed at or near grade level, thereby permitting future access to the below-grade utility or utilities housed by the components comprising the entire enclosure. With an extraordinary number of box enclosures still in place today, the foremost limitation of conventional utility box lids is that they lack the ability to be adequately fastened. Other utility box lids are equipped to be fastened using threaded fasteners but the heads of the fasteners are typically exposed and easily accessible thereby minimally restricting unauthorized access.

Thereafter, other methods of securing a utility box lid to the enclosure box were designed but also suffer from limitations. Some devices utilize a bolt-type fastener where the fastener is configured in an L-shaped formation, which differs fundamentally from the aforementioned conventional methods. However, the commonality is that the head of the fasteners are also upwardly exposed, rendering the utility box easily accessible and therefore allowing for the possibility of unauthorized manipulation of the fastener and access to the contents housed in the enclosures. In other existing devices, a keyed cylinder and accompanying key are used to secure a small door over a cavity housing the locking mechanism lever. The orientation of this cylinder is such that the entry point for the key is upward facing making it prone to receive granular particles such as dirt, sand, etc. that could prevent the key from entering the cylinder. The keyed cylinder may also be made not to function properly should an improper object be jammed or forced into the keyed aperture. In the same disclosure, a secondary means of securing the enclosure is a lever equipped with a hasp-type feature to accept a common padlock. In addition to the same susceptibility to granular particles, padlocks expose another set of disadvantages in that they can be easily cut or pried open.

Still other devices utilize a locking mechanism that rotates rods to a position beneath a rim of the enclosure box. Such devices are implemented by either retrofitting to an existing lid or by being integrated within a newly manufactured lid. Contemplating the retrofit option, one disadvantage exists in that attachment to an existing lid requires several holes to be accurately drilled to accept at least eight bolts. This method of implementation is largely impractical given that conventional lids are generally made of sturdy materials of varying thicknesses such as concrete, steel and the like. Thus, drilling a number of holes would be time consuming and cost prohibitive thereby restricting its potential applications. Further contemplating either method of implementation, another significant disadvantage is that such devices are dependant on a sheer horizontal lower lip to be present within the enclosure box in order for the lid to be retained as intended. This dependency further limits its potential use to existing enclosures with lips or alternatively, it would increase preparation time where modification to the enclosure box would be necessary. Yet another disadvantage is noticed with this type of locking mechanism in that the devices require no more than 180 degrees of rotation to disengage the locking rods. Further, the mechanisms appear not to have an adequate restraint function to keep the rotational portion of locking mechanism from freely spinning Hence, an object other than the intended key could be forced into the key aperture to manipulate the locking mechanism with a half-turn to gain access to the enclosure therefore further diminishing the effectiveness of the mechanisms.

Yet another existing method utilizes a Y-shaped device that engages under the lower edge of the sidewalls of an enclosure box coupled with a padlock or similar device. The upper tab provided on the device is intended to penetrate through the existing enclosure lid where the padlock or other locking device can be attached. This method has several apparent disadvantages in that: 1) the installer of the device is required to undermine beneath the bottom edge of the enclosure to fit the device in position which can be time consuming and problematic; 2) the enclosure lid requires preparation in that a slot must be cut into the lid so as to accept the upper tab of the device which can be time consuming and problematic; 3) obstructions present in the enclosure such as conduit, pipe, cabling, meters, etc. or in cases where the bottom opening of the enclosure is sealed with a cement slurry mixture or other hardened material will further prolong or prevent installation; 4) the keyed padlock or similar locking device mounted above the surface of enclosure lid creates a tripping hazard for pedestrians where applications in paths of travel occur furthering its limitations.

Other known devices do not incorporate the utility box lid. Rather, these devices insert into the cavity of the enclosure itself. Some such devices engage under the lower edge of the sidewalls of an enclosure box coupled with a padlock. The padlock retains a secondary cover below the existing enclosure lid. Another such device utilizes a keyed locking cylinder in lieu of a padlock to retain a secondary cover.

Accordingly, there is a need in the field of utility box lids for an improved lockable utility box lid to minimize unauthorized access to the utility box and its contents and further reduce the risk of losses associated with the theft, vandalism, injury, repairs, related expenses and resources. Thus several advantages of one or more aspects are to provide a universally lockable utility box lid. Other advantages of one or more aspects are to provide a lockable utility box lid devoid of padlocks, keyed cylinders, readily accessible or exposed and unsecured fasteners and the like. These and other advantages of one or more aspects will become apparent from consideration of the ensuing description and drawings.

SUMMARY OF THE INVENTION

The present invention is directed to a lockable utility box lid. The utility box lid includes at least one aperture therethrough for receiving a fastener. The locking mechanism preferably includes a utility box engagement member coupled to the underside of the utility box lid. The locking mechanism is movable between a locked and unlocked position. A fastener extends through the opening in the utility box lid and engages the locking mechanism. Rotating the fastener in a first direction causes the locking mechanism to assume a first, locked position. Rotating the fastener in a second direction causes the locking mechanism to assume a second, unlocked position. In the locked position the utility box engagement member is engaged with an interior surface of the utility box lid.

In another embodiment of the invention, the utility box engagement member is a clamp.

In still another embodiment of the invention, the fastener is a security fastener.

In another embodiment of the invention, the security fastener comprises a head sized and shaped in a non-standard manner to mate with a tool having a complementary size and shape.

In another aspect of the invention, a lockable utility box lid includes at least one aperture defined therein. At least one clamping mechanism is coupled to the underside of the lid. The at least one clamping mechanism includes a bolt having a threaded first end and an opposing second end, the second end having an integral bolt head further including a cavity. The clamping mechanism further includes a lock plate and a plurality of side plates coupled at right angles to the lock plate. The side plates are also coupled at right angles to the underside of the lid. The lock plate is coupled to the side plates at a spaced location so as to allow a predetermined space between the opposing surfaces of the lock plate and the utility box lid. The clamping mechanism also includes a back plate with a first bolt aperture pivotably coupled to the plurality of side plates, a pivot arm including a second bolt aperture pivotably coupled to the lock plate, a threaded plate having a threaded aperture pivotably coupled to the pivot arm, and a means for urging the pivot arm in an upwardly outward direction such that the pivot arm is caused to forcefully engage one or more interior walls of the utility box.

In another embodiment of the invention, the bolt is sequentially inserted through the first bolt aperture of the back plate, the second bolt aperture of the pivot arm, and rotatably inserted into the threaded aperture of the threaded plate.

In another embodiment of the invention, the utility box lid includes an upper surface and a lower surface. At least one clamping mechanism is attached to the lower surface of the utility box lid, the clamping mechanism selectively adjustable between a first locked position and a second unlocked position. When in a locked position, the clamping mechanism moves outwardly with respect to a center of the utility box lid to engage one or more interior wall of the utility box enclosure.

In another embodiment of the invention, the utility box lid defines an upper aperture having a first end larger and a second end smaller. The lid further includes a lock plate fixedly attached to the lower surface of the utility box lid, the lock plate defining a lower aperture having a first larger end and a second smaller end. The lock plate is oriented such that the first larger end of the upper aperture is aligned with the second smaller end of the lower aperture. The clamping mechanism is selectively adjustable between locked and unlocked positions by use of a tool extending through the upper aperture and lower aperture.

Another embodiment of the invention provides a method of locking a utility box. The method includes the steps of providing a utility box lid having a security fastener and locking mechanism associated there with, the security fastener comprising a head sized and shaped in a non-standard manner, and providing a tool for manipulating the security fastener. An end of the tool has a size and shape complementary to the security fastener. When the security fastener is rotated in a first direction, the locking mechanism assumes a first, locked position. When the security fastener is rotated in a second direction, the locking mechanism assumes a second, unlocked position.

In another embodiment of the invention, the locking mechanism of the above method includes a clamp that engages an interior surface of a utility box when the locking mechanism is in the first, locked position.

DETAILED DESCRIPTION OF THE INVENTION

Figure 1A:
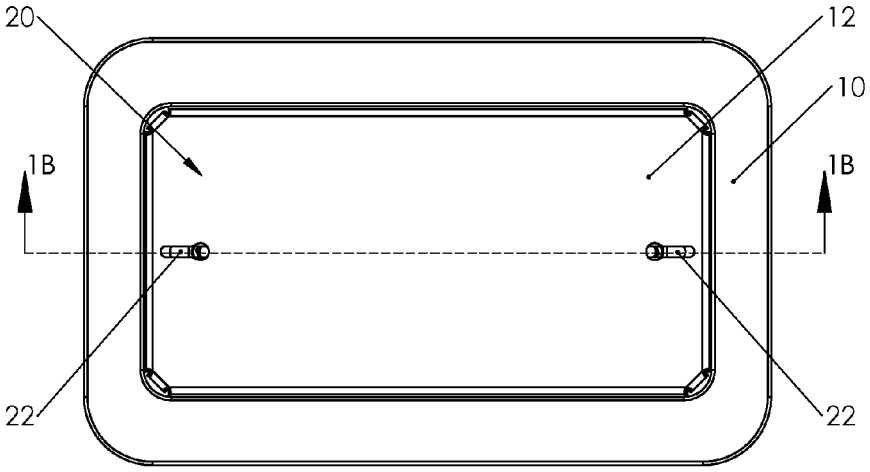
FIG. 1A is a top view of a lockable utility box lid on a utility box enclosure in accordance with the present invention.
Figure 1B:
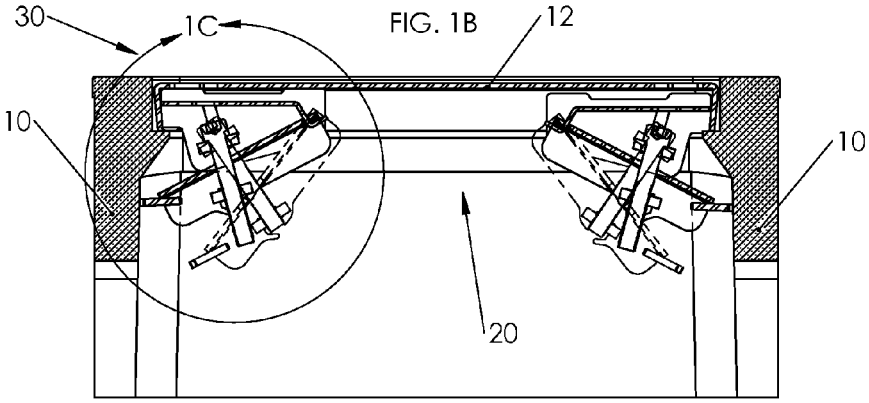
FIG. 1B is a section view along section line 1B-1B of FIG. 1A of a lockable utility box lid on a utility box enclosure in accordance with the present invention.
Figure 1C:
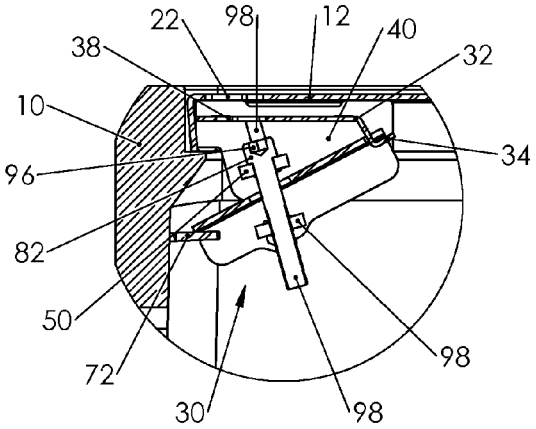
FIG. 1C is a magnified view of detail C of a clamping mechanism taken from FIG. 1B and from along section line 1B-1B of FIG. 1A of a lockable utility box lid on a utility box enclosure in accordance with the present invention.
Figure 2:
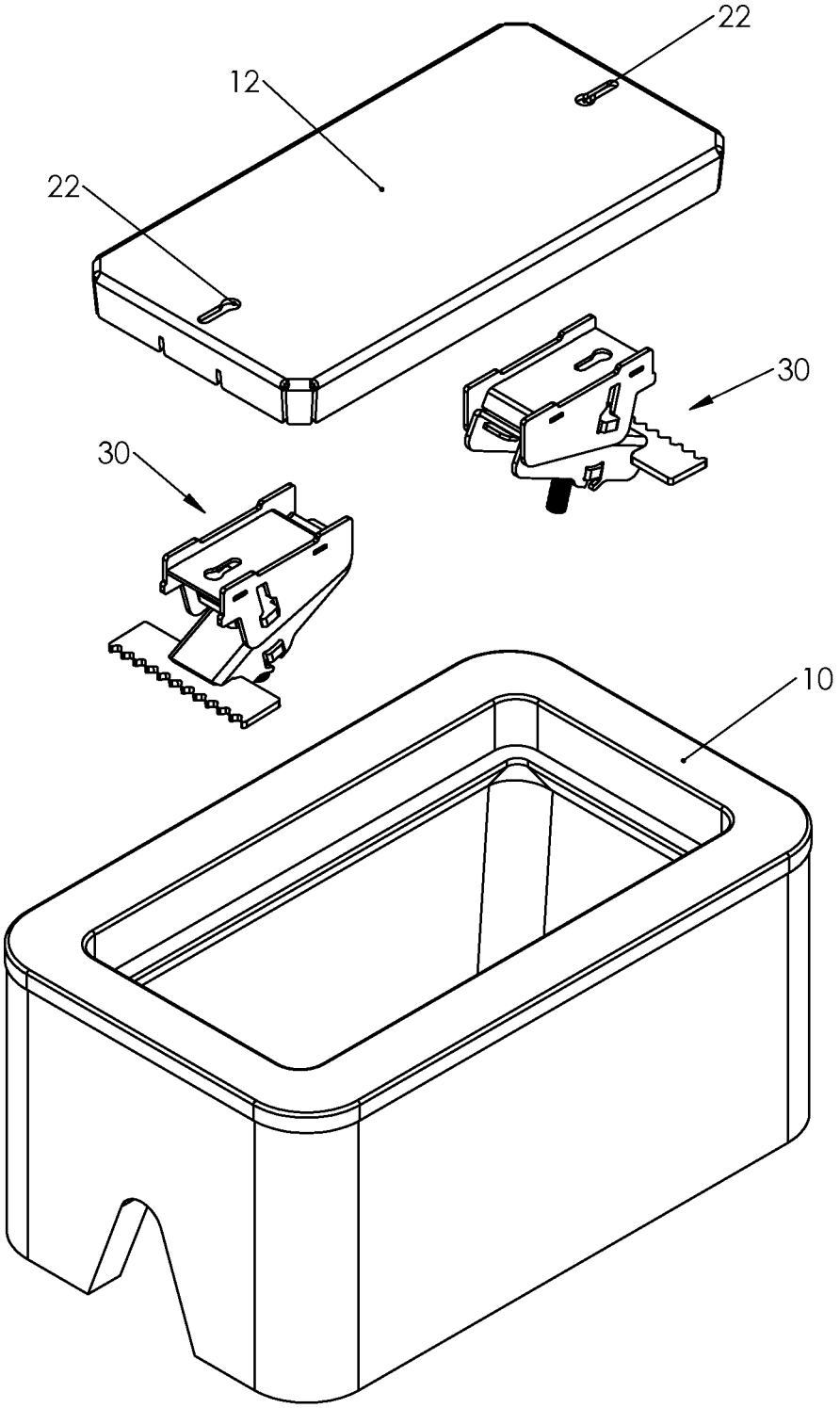
FIG. 2 is a semi-exploded perspective view of a box lid and a plurality of clamping mechanisms in relationship to a utility box enclosure in accordance to the present invention.

One embodiment of a lockable utility box lid is illustrated in FIG. 1A (top view), FIG. 1B (section view), FIG. 1C (magnified section view of clamping mechanism) and FIG. 2 (semi-exploded view). FIG. 1A depicts a top view of a lockable utility box lid 20 in place within a utility box enclosure 10 over the upward facing open end of the box where FIG. 1B depicts a section view taken along section line 1B-1B of FIG. 1A. The box lid 12 may include one or more upper keyhole-shaped tool apertures 22 to allow access to a clamping mechanism 30 coupled to the box lid 12. A lockable utility box lid 20 may comprise at least one clamping mechanism 30 coupled with a box lid 12 as shown in FIG. 2. The at least one clamping mechanism 30 may be a plurality of clamping mechanisms 30. Referencing FIG. 1C with further reference to FIG. 3A (perspective view of a clamping mechanism), the clamping mechanism 30 may comprise a lock plate 32, at least one side plate 40, a pivot arm 60, a jaw plate 72, a back plate 50, a threaded plate 64, and a threaded bolt 80. The clamping mechanism 30 may be coupled to the underside of the box lid 12 to allow the pivot arm 60 to be drawn upward and/or outward so that at least one surface of the jaw plate 72 engages against one or more vertical, horizontal or angled inward or downward facing surfaces of the enclosure box 10 as shown in FIG. 1B.

Figure 3A:
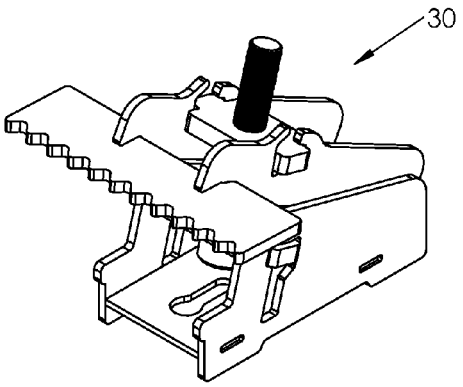
FIG. 3A is a perspective view of a clamping mechanism in accordance with the present invention.
Figure 3B:
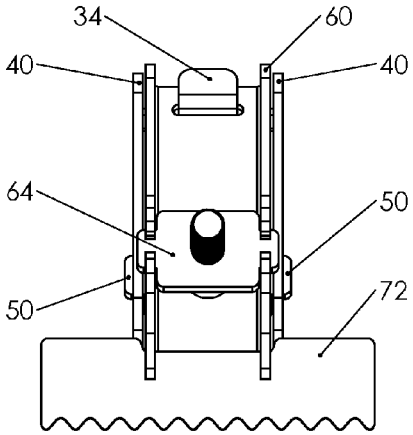
FIG. 3B is a bottom view of a clamping mechanism in accordance with the present invention.
Figure 3C:
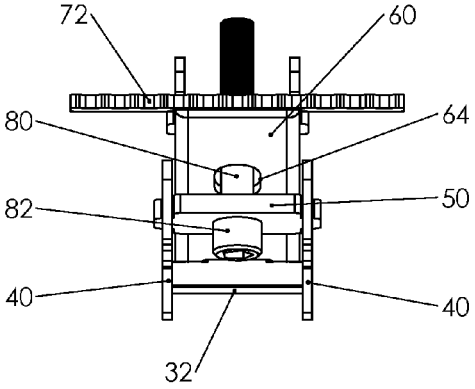
FIG. 3C is a front view of a clamping mechanism in accordance with the present invention.
Figure 3D:
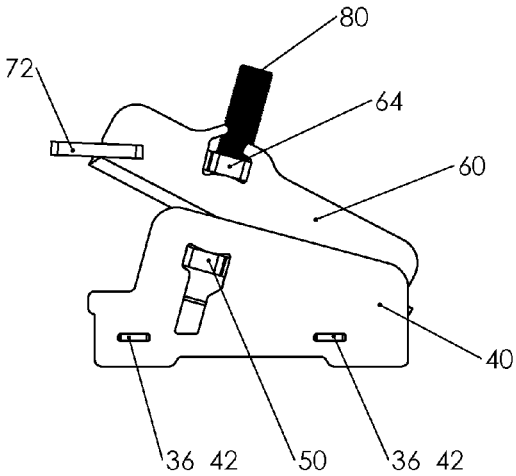
FIG. 3D is a side view of a clamping mechanism in accordance with the present invention.
Figure 4:
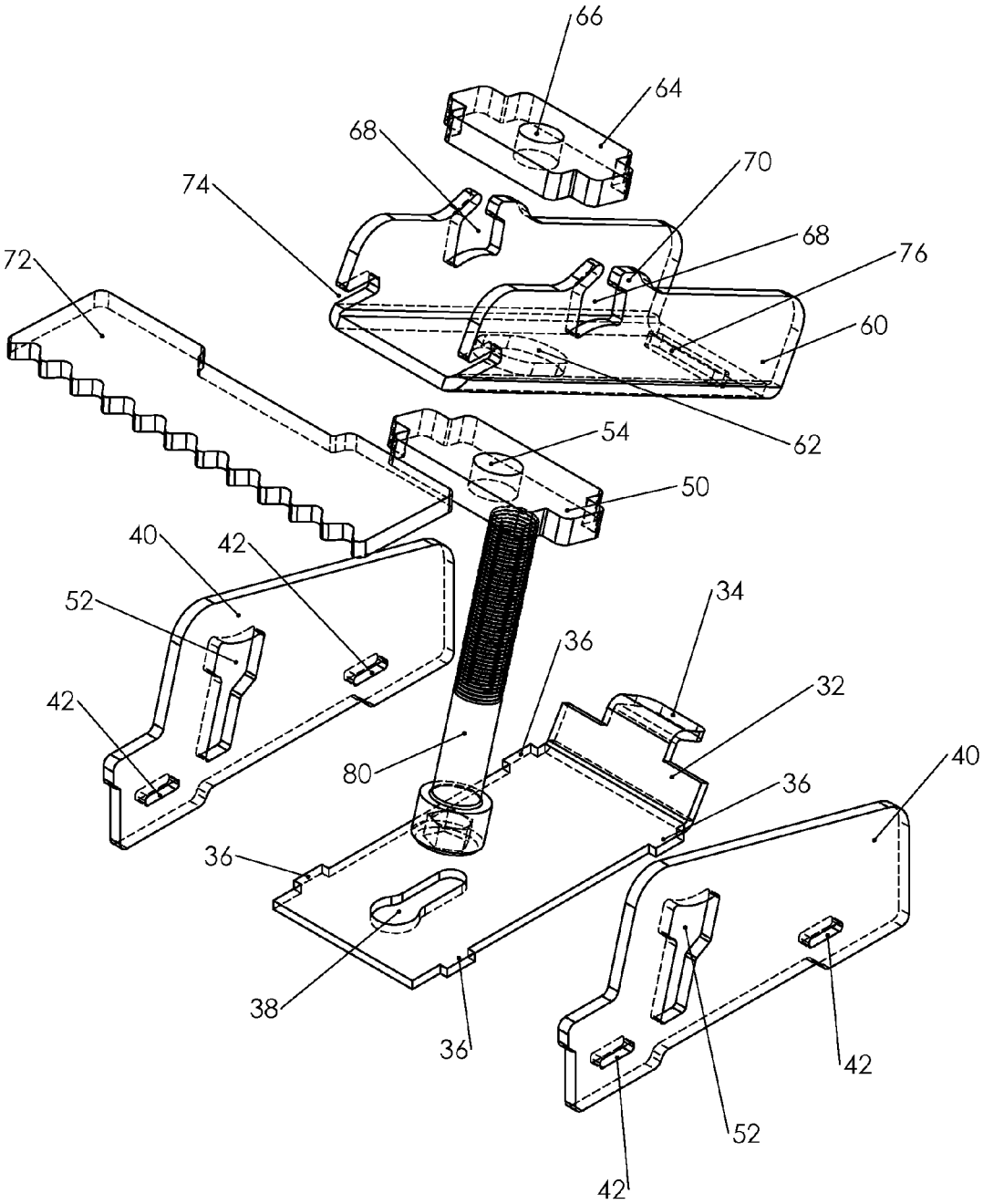
FIG. 4 is an exploded view of a clamping mechanism in accordance with the present invention.

Referring to FIG. 4 with further reference to FIG. 3A, the clamping mechanism 30 may comprise a lock plate 32 comprising a pivot tab 34, a lower keyhole-shaped tool aperture 38 and a plurality of index tabs 36. The lock plate 32 may be coupled to a plurality of side plates 40 each comprising a back plate aperture 52 and a plurality of side plate index tab slots 42. The clamping mechanism 30 may also comprise a jaw plate 72 coupled to a pivot arm 60 comprising a pivot tab aperture 76, a jaw plate index slot 74 and a pivot arm bolt aperture 62. Further, the pivot tab 34 of the lock plate 32 may be inserted through the pivot tab aperture 76 of the pivot arm 60; a back plate 50 comprising a first bolt aperture 54 inserted to its shoulders through the back plate apertures 52 in the plurality of side plates 40; a threaded plate 64 comprising a threaded aperture 66 inserted to its shoulders into the threaded plate apertures 68 of the pivot arm 60 and retained in position by threaded plate keeper tabs 70. The clamping mechanism 30 may also comprise a threaded bolt 80 first inserted through the first bolt aperture 54 of the back plate 50, again inserted through the pivot arm bolt aperture 62 of the pivot arm 60 and finally rotationally inserted into the threaded aperture 66 of the threaded plate 64. The clamping mechanism 30 may be coupled to the underside of the box lid 12.

Figure 5A:
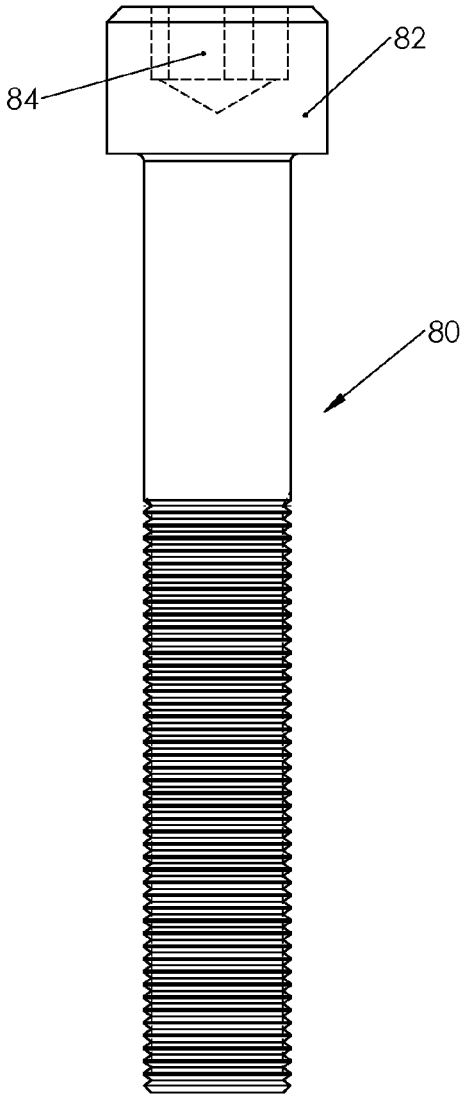
FIG. 5A is a side view of a bolt accordance with the present invention.
Figure 5B:
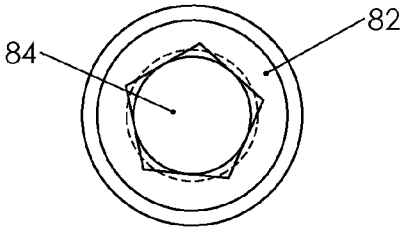
FIG. 5B is a top view of a bolt head of a bolt accordance with the present invention.

With reference to FIG. 2, the clamping mechanism 30 may be coupled to the underside of the box lid 12 so that the lower keyhole-shaped tool aperture 38 aligns with the upper keyhole-shaped tool aperture 22 of the box lid 12. The upper keyhole-shaped tool aperture 22 may comprise a first circular aperture end transitioning to a second linear aperture end resembling a "keyhole." The lower keyhole-shaped tool aperture 38 may comprise a first linear aperture end transitioning to a second circular aperture end also resembling a "keyhole." The clamping mechanism 30 may be coupled to the underside of the box lid 12 so that the second circular end of the lower keyhole-shaped tool aperture 38 of the lock plate 32 is reversely aligned with the first circular end of the upper keyhole-shaped tool aperture 22 of the box lid 12. Referring to FIGS. 5A and 5B, the threaded bolt 80 comprising a bolt head 82 and a bolt head cavity 84 may be aligned beneath the second linear end of the lower keyhole-shaped tool aperture 38 so that the bolt head cavity 84 cannot be directly accessed therethrough. It shall be understood that the second linear end of the upper keyhole-shaped tool aperture 22 and the first linear end of the lower keyhole-shaped tool aperture 38 may be substantially narrower than the bolt head cavity 84 and the tool head 96 (illustrated in FIGS. 6A and 7A). Therefore, given the oppositely aligned keyhole shaped apertures of the upper keyhole-shaped tool aperture 22 and the lower keyhole-shaped tool aperture 38, direct access to engage the threaded bolt 80 of the clamping mechanism 30 is prevented in that the second linear end of the upper keyhole-shaped tool aperture 22 of the box lid 12 is oriented directly over to the second circular end of the lower keyhole-shaped tool aperture 38 thereby creating an indirect path to engage the clamping mechanism 30. It shall be further understood that the terms "circular," "linear" and "keyhole" used in reference and to describe the illustrations and relationship of one or both the upper keyhole-shaped tool aperture 22 and lower keyhole-shaped tool aperture 38 are for exemplary purposes and is in no way a limitation of shape, configuration, or relationship of one, the other or both of the apertures.

Figure 6A:
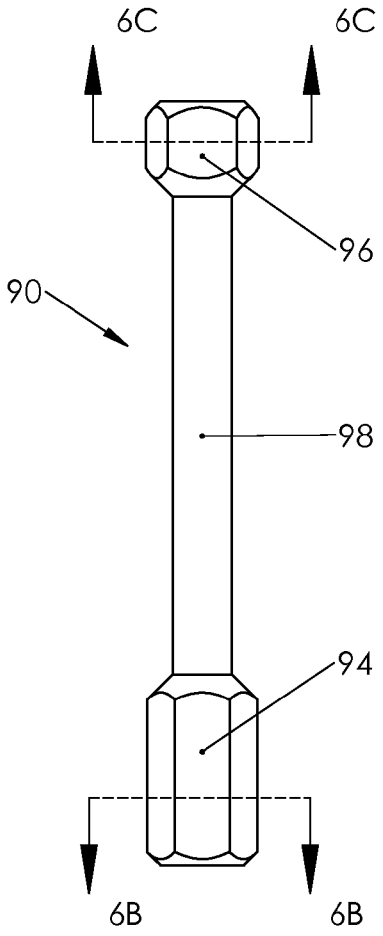
FIG. 6A is a side view of a straight-shank tool in accordance with the present invention.
Figure 6B:
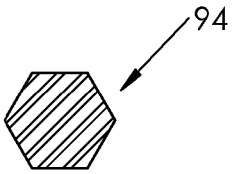
FIG. 6B is a section view along section line 6B-6B of FIG. 6A of an operative first end of a straight-shank tool in accordance with the present invention.
Figure 7A:
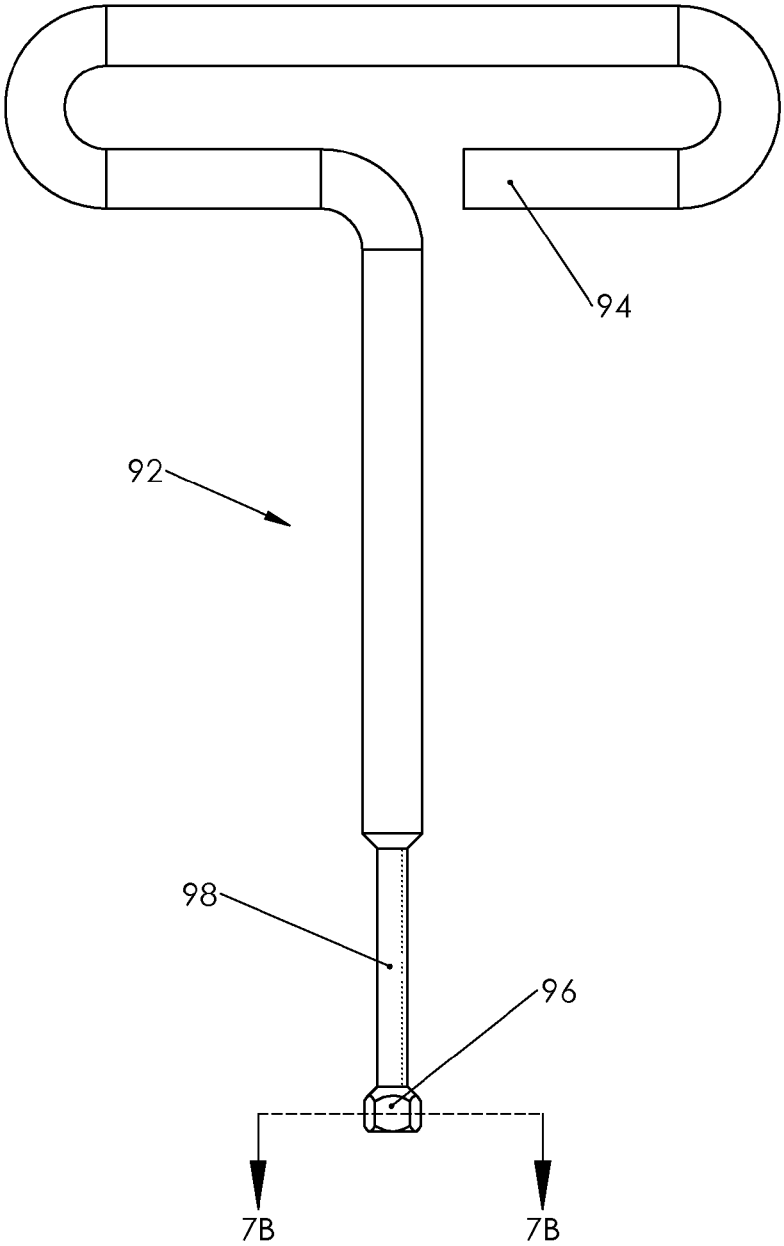
FIG. 7A is a side view of a handled tool in accordance with the present invention.

The one or more clamping mechanisms 30 coupled to the underside of the box lid 12 may be mechanically transitioned between an engaged (locked) and disengaged (unlocked) position using a straight-shanked tool 90 or a handled tool 92 such as depicted in FIGS. 6A and 7A respectively. Each the straight-shanked tool 90 and the handled tool 92 comprise an operative tool end 94, a tool head 96 and a reduced tool shank section 98 again as depicted in FIGS. 6A and 7A respectively. Rotation of the threaded bolt 80 engaged at the bolt head cavity 84 with a tool head 96 by mechanically or manually rotating the operative tool end 94 may produce transitional movement of the pivot arm 60 and jaw plate 72 of the clamping mechanism 30 between an engaged (locked) and disengaged (unlocked) position.

Figure 6C:
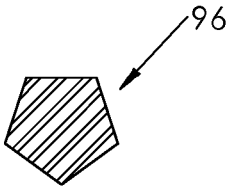
FIG. 6C is a section view along section line 6C-6C of FIG. 6A of an engaging second end of a straight-shank tool in accordance with the present invention.
Figure 7B:
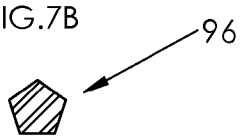
FIG. 7B is a section view along section line 7B-7B of FIG. 7A in accordance with the present invention.

Referring further to the drawings, FIG. 5B depicts a bolt head 82 and a bolt head cavity 84 having a pentagonal figure. It shall be understood that the shape of the bolt head cavity 84 may include any rectilinear, cylindrical, conical or other geometric shape or combinations thereof, either sectional or cross-sectional. Additionally, the tool head 96 as shown in the cross-sectional views of FIGS. 6C and 7B may also include any rectilinear, cylindrical, conical or other geometric shape or combinations thereof, either sectional or cross-sectional to correspond with the bolt head cavity 84.

It shall be understood that the lock plate 32 and the one or more side plates 40 may be coupled together and the pivot arm 60 and the jaw plate 72 may be coupled together and the clamping mechanism 30 and the box lid 12 may be coupled together by use of any type of coupler, including, but not limited to a weld, a nut and bolt, a clip, an adhesive, a rivet, a screw, or any other type of coupler or combinations thereof. It shall be further understood that any of the components defining any embodiment of a locking utility box lid 20 may be separately or monolithically formed, stamped, cast, molded, forged, extruded, milled or the like of any of many different types of materials (such as metals, alloys, glasses, polymers, composites, epoxies or other suitable materials irrespective of composition or method) or combinations thereof that can be readily formed into shaped objects provided that the materials or combinations thereof, including any additional steps or procedures (such as galvanizing, plating, anodizing, or any other type of coating; reinforcing, bifurcating, trifurcating, or the like) are consistent with the intended operation of a lockable utility box lid 20.

The lockable utility box lid 20 may be used in conjunction with a utility box enclosure 10 as depicted in FIG. 1A. The term "utility box enclosure" may be any type of enclosure including, but not limited to a pull box, a splice box, an access box, a valve box, a meter box, a service box, a vault and the like regardless of size, physical elements or features, material composition, whether or not in service (installed and in use), whether or not planned for service (intended to be installed in the future), or whether or not below-grade, at-grade or above-grade.

The sequential illustrations of FIGS. 8A thru 8F depict of a method of inserting the handled tool 92 into the clamping mechanism 30 as follows: The tool head 96 is first inserted downwardly through the first circular end of the upper keyhole-shaped tool aperture 22 of the box lid 12 followed by a second lateral movement of the handled tool 92 towards the second linear end of the upper keyhole-shaped tool aperture 22. With this second movement, the reduced tool shank 98 allows for the movement of the handled tool 92 into the second linear end of the upper keyhole-shaped tool aperture 22 while the tool head 96 passes beneath the same second end of the upper keyhole-shaped tool aperture 22 of the box lid 12. The third movement is again a downward so that the tool head 96 passes through the second circular end of the lower keyhole-shaped tool aperture 38 of the lock plate 32. The fourth movement is again a lateral movement (opposite the second movement) passing the tool head 96 beneath the first linear end of the lower keyhole-shaped tool aperture 38 of the lock plate 32 to a position over the bolt head cavity 84 of the bolt head 82. With the fifth and final downward movement, the tool head 96 is inserted into the bolt head cavity 84.

Referring again to FIG. 1B with further reference to FIG. 4, the threaded bolt 80 of the clamping mechanism 30 is retained in position underneath the lower tool aperture 38 by the back plate 50 whereby the first bolt aperture 54 of the back plate 50 is slightly larger than the shank of the threaded bolt 80 but smaller than the bolt head 82, thus allowing the threaded bolt 80 to be inserted therethrough and freely spin within the first bolt aperture 54. The back plate 50 is retained by the back plate apertures 52 of the side plates 40 which are coupled to the lock plate 32 and the underside of the box lid 12. The pivot tab 34 of the lock plate 32 is inserted into the pivot tab aperture 76 of the pivot arm 60 which is coupled to the jaw plate 72 where the threaded bolt 80 is then inserted through the second bolt aperture 62 of the pivot arm 60. The threaded plate 64 is inserted into the threaded plate aperture 68 of the pivot arm 60 and retained in position by the threaded plate keeper tabs 70 where the threaded bolt 80 is finally rotationally inserted into the threaded aperture 66 of the threaded plate 64.

Considering at least the foregoing, the clamping mechanism 30 can be transitionally maneuvered between an engaged (locked) and disengaged (unlocked) position by rotating the operative tool end 94 while the tool head 96 is engaged in the bolt head 82 of the clamping mechanism 30.

Rotation of the operative tool end 94 in a clockwise rotation will produce an upward and outward movement of the pivot arm 60 causing the jaw plate 72 to become in contact against one or more vertical, horizontal or angled inward or downward facing surfaces of the enclosure box 10 (as shown in FIG. 1B) thereby eventually exerting a measurable amount of force against said surface(s). Again referring to FIG. 1B, one embodiment of the present invention includes a second clamping mechanism 30 coupled to the underside of the box lid 12 opposite the first clamping mechanism 30. Engaging (locking) the second locking 30 in the same manner as the first clamping mechanism 30 as described above, the second clamping mechanism 30 will also eventually exert a measurable amount of force against an opposite one or more vertical, horizontal or angled inward or downward facing surfaces of the enclosure box 10 again as shown in FIG. 1B.

In the engaged position, the opposing upward and outward force exerted by the clamping mechanism(s) 30 against opposite vertical, horizontal or angled inward or downward facing surfaces of the enclosure box 10 coupled to the box lid 12 thereby restricts the unauthorized removal of the lockable utility box lid 20.

To disengage the clamping mechanisms 30, rotation of the operative tool end 94 in a counterclockwise rotation will produce a downward and inward movement of the pivot arm 60 causing the jaw plate 72 to disengage from the one or more vertical, horizontal or angled inward or downward facing surfaces of the enclosure box 10 as shown in phantom lines in FIG. 1B thereby eventually relieving the exerted force against said surface(s).

Other particular embodiments of the present invention may include a clamping mechanism 30 that is coupled to the underside of the box lid 12 where the pivot arm 60 and coupled jaw plate 72 are immovably coupled to the one or more side plates 40 or the box lid 12 resembling an operational clamping mechanism 30. Further other particular embodiments of the present invention may include a plurality of box lids 12 coupled with one or more clamping mechanisms 30 capable of being sequentially interlocked or situated in the same upward facing open end of the utility box enclosure 10 to comprise a lockable utility box lid 20.

Referring to FIG. 5A, the threaded bolt 80 may be reversely threaded so that a counterclockwise rotation of the operative tool end 94 while engaged in the bolt head 82 will produce the upward and outward movement of the pivot arm 60 and a clockwise rotation will produce a downward and inward movement. Additionally, the bolt head 82 may comprise a bolt head cavity 84 comprising any rectilinear, cylindrical, conical or other geometric shape or combinations thereof where the tool head 96 corresponds with said shapes or combinations. Oppositely, the tool head 96 may comprise a tool head cavity (not shown) comprising any rectilinear, cylindrical, conical or other geometric shape or combinations thereof where the bolt head 82 corresponds with said shapes or combinations of the tool head cavity (not shown).

Figures 8A, 8B, 8C, 8D, 8E, 8F:
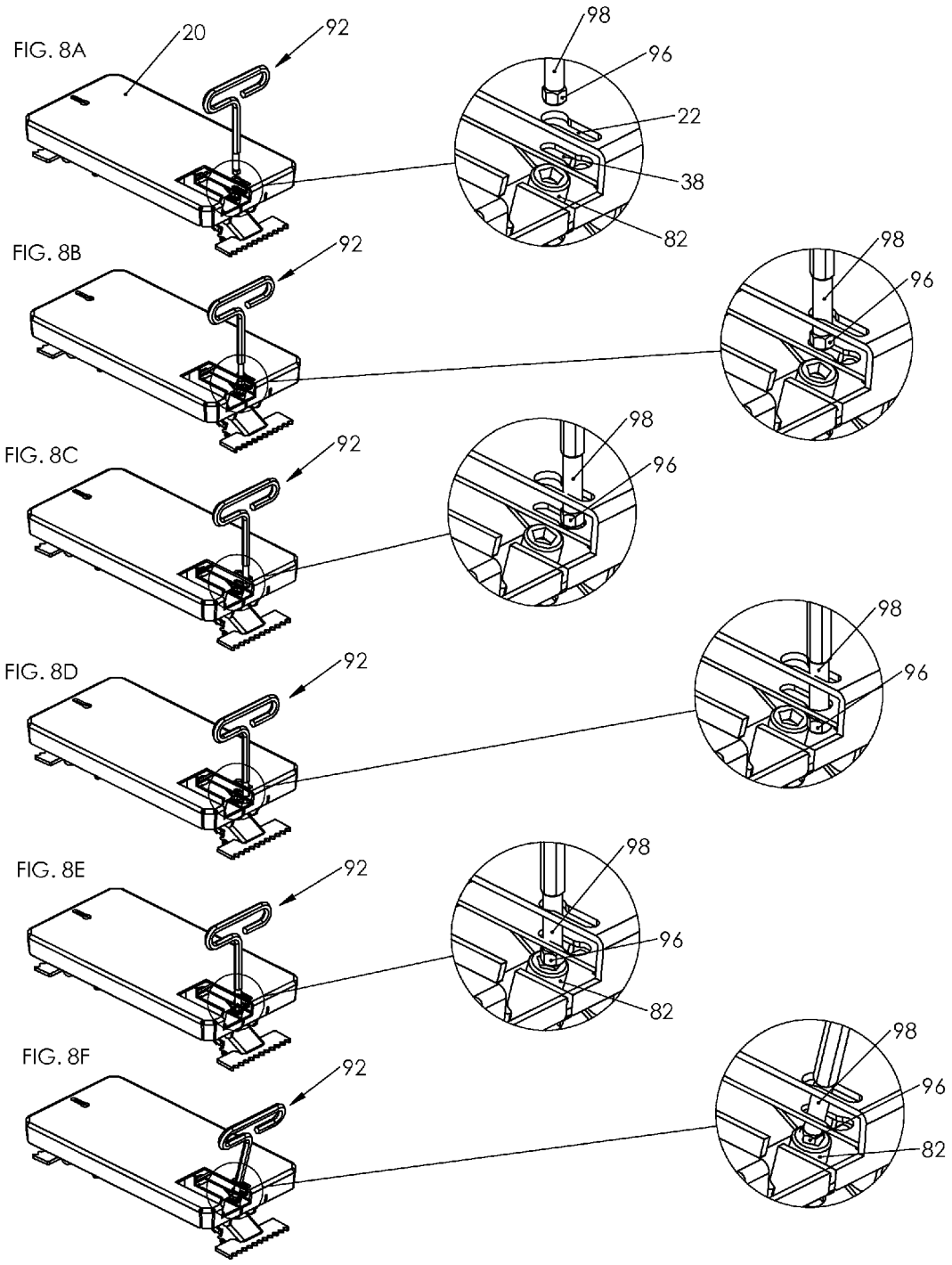
FIGS. 8A thru 8F is a flow chart of a method of engaging a clamping mechanism with a handled tool or straight-shank tool (not shown) with a cutaway section for clarity in accordance with the present invention.

Referring to FIG. 7A with further reference to FIG. 8C, the handled tool 92 may double as a lifting device where, as depicted in FIG. 8C, an upward movement at this position would engage the tool head 96 with the underneath side of the second linear end of the upper keyhole-shaped tool aperture 22 of the box lid 12 thereby displacing the lockable utility box lid 20 from the upper open end of the utility box enclosure 10.

A wide variety of utility box lids may be provided utilizing the general principles of the present invention. Such utility box lids may include, for example, apertures for receiving a fasteners therethrough. A locking mechanism is provided, associated with an underside of utility box lid. The locking mechanism includes a utility box engagement member adapted to engage an interior surface of a utility box when the locking mechanism is in a locked position. In some embodiments of the present invention, the utility box engagement member is a clamp. Some embodiments may include two locking mechanisms, one at each long end of utility box lid. Each locking mechanism is engaged using a tool designed to mate with the respective fastener for each locking mechanism. Rotation of the fasteners using the tool causes the corresponding locking mechanism to move between a first, locked position and a second, unlocked position. It is contemplated that rotation of the fastener in one direction locks the locking mechanism, while rotation of the fastener in a second direction unlocks the locking mechanism. It is to be understood that in various embodiments of the invention, the apertures may be present in any shape, number, or configuration.

It is further contemplated that the two locking mechanisms may be coupled in such as manner as to allow only a single aperture in a utility box lid, and a single fastener extending therethrough. In such embodiments, the single fastener is engaged to move both locking mechanisms between a locked and unlocked position.

As noted previously, the fasteners (described as bolt heads in previous embodiments) may have any suitable sectional or cross-sectional shape or configuration. The tool used to rotate the fasteners has a shape or configuration complementary to that of the fasteners. Such fasteners may be described as security fasteners, because the non-standard head of the fastener limits access to those having the appropriate tool with the complementary design. Thus, in such embodiments of the invention, access to the utility box via the utility box lid may be limited by providing a limited number of such tools to select individuals authorized to access the utility box. Though security fasteners are used in some embodiments of the invention, it is contemplated that any suitable fastener may be used, including a standard fastener.

Although the embodiments shown in the FIGs employ clamps as part of the locking mechanisms associated therewith, it is contemplated that any locking mechanism that engages with an interior surface of a utility box may be utilized. Such utility box engagement members are preferably engaged by rotation of one of more fasteners within, or accessible through, the utility box lid.

Accordingly the reader will see that various embodiments of the lockable utility box lid provide a more reliable, practical and universal device that will significantly lessen unauthorized access to valuable assets contained within the confines of utility box enclosures. In addition, the components of the various embodiments of the locking utility box lid combine to clamp into place over the upward facing opening of the utility box. Some embodiments further enhance the effectiveness of the lockable utility box lid where an intentionally indirect tool path to the operative components of the clamping mechanism and an irregular bolt head cavity configuration further reduce the possibility of tampering with or manipulation of the clamping mechanism and/or removal of the lockable utility box lid. Furthermore, the locking utility box lid has the additional advantages in that:

it permits the production of the lockable utility box lid in any combination of length, width and/or height to retrofit into any sized utility box opening;

it permits modular production of the lockable utility box lid where any number of box lid sections coupled with one or more embodiments of the present invention can be configured to retrofit into any sized utility box opening;

it permits efficient installation attributable to the absence of component parts requiring mechanical or manual attachment to, or engagement of, the utility box enclosure; it further permits efficient installation whereby no physical modification of the utility box enclosure is needed or required;

it permits more resistance to tampering attributable to the absence of fasteners that are directly or plainly exposed; it further permits more resistance to tampering due to the absence of padlocks and/or keyed cylinders; and it permits a greater functional reliability whereby the clamping mechanism of the lockable utility box lid is less prone to be clogged by granular particles such as sand, dirt, etc. or other environmental elements in comparison to padlocks and/or keyed cylinders where these elements may cause malfunction; it further permits a greater functional reliability whereby the clamping mechanism of the lockable utility box lid is less prone to being damaged by forceful insertion of improper objects where the same may render padlocks and/or keyed cylinders non-functional.

Although the description above contains many specificities, these should not be construed as limitations on the scope, but rather as an exemplification of one preferred embodiment thereof. Many other variations are possible. For example, the box lid of the lockable utility box lid can have other shapes such as square, round, oval, triangular, pentagonal, hexagonal, heptagonal, octagonal, etc.; the box lid can be modularized whereby each module can be coupled with one or more clamping mechanisms; the at least one clamping mechanism of a singular or modularized box lid can be a plurality of clamping mechanisms; the clamping mechanism can be made to maintain a fixed position; the clamping mechanism be can made to engage other integral physical elements of a utility box enclosure such as a rib, a lip, a cavity in a sidewall or the like without the use of force; the bolt head cavity can have other sectional or cross-sectional shapes such as square, round, oval, triangular, pentagonal, hexagonal, heptagonal, octagonal, conical, etc. or any combination thereof; the tool head insertable into the bolt head cavity can correspond to any shape of the bolt head cavity; the tool head can conversely comprise a cavity whereby the bolt head can correspond to a tool head cavity shape thereof; the threads of the bolt can be reversely threaded, coarsely threaded, finely threaded, a combination thereof or the like; the upper tool aperture can have other shapes; the lower tool aperture can have other shapes; one or more intermediate tool apertures can be incorporated between the upper tool apertures and the lower tool apertures; the fulcrum point of the pivot arm and pivot tab can be replaced with a hinge having a hinge pin or the like; the jaw plate can have other shapes; the jaw plate can be eliminated; the pivot arm and jaw plate can be made integrally; the pivot arm can be shortened, elongated, narrowed, widened, or any combination thereof or have other shapes; the side plate can have other shapes; the lock plate can be shortened, elongated, narrowed, widened, or any combination thereof or have other shapes; the side plate and lock plate can be made integrally; the lock plate index tabs and the side plate index tab slots can be eliminated; the back plate and threaded plate can have different shapes; the threaded plate can have a threaded aperture corresponding to the bolt threads; any of the components defining any embodiment of a lockable utility box lid may be made of any of many different types of materials or combinations thereof that can be formed into shaped parts provided the materials utilized are consistent with the intended use and operation of the lockable utility box lid; the box lid can be formed of sheet materials having integral slip resistant characteristics such as tread plate, diamond plate, etc; any of the components defining any embodiment of a lockable utility box lid may be coated with any of many different types of protective coatings or combinations thereof; the protective coatings can have an established static coefficient of friction for slip resistance, etc.

Accordingly, the scope should be determined not by the embodiments illustrated, but by the appended claims and their legal equivalents.

Having thus described the preferred embodiment of the invention, what is claimed as new and desired to be protected by Letters Patent includes the following:

1. A lockable utility box lid comprising:

a utility box lid having an upper surface and a lower surface, a longitudinal axis extending from a first edge to an opposing second edge thereof, and at least one aperture therethrough for receiving a fastener;

a locking mechanism comprising a utility box engagement member coupled to an underside of the utility box lid, the locking mechanism movable between a first position and a second position; and a fastener extending through the opening of the utility box lid and engaging the locking mechanism, wherein rotation of the fastener in a first direction causes the locking mechanism to undergo movement along the longitudinal axis of the lid and assume a first position wherein the utility box engagement member is engaged with an interior surface of the utility box, wherein rotation of the fastener in a second direction causes the locking mechanism to undergo movement along the longitudinal axis of the lid and assume a second position wherein the utility box engagement member is disengaged from the interior surface of the utility box, and further wherein said fastener does not extend above the upper surface of the lid when the locking mechanism is in the locked position or when the locking mechanism is in the unlocked position.

2. The lockable utility box lid of claim 1, wherein the utility box engagement member is a clamp.

3. The lockable utility box lid of claim 1, wherein the fastener is a security fastener.

4. The lockable utility box lid of claim 3, wherein the security fastener comprises a head sized and shaped in a non-standard manner to mate with a tool having a complementary size and shape.

5. A lockable utility box lid comprising:

at least one utility box lid having at least one aperture defined therein;

at least one clamping mechanism coupled to underside of the lid, the at least one clamping mechanism comprising:

a bolt comprising a threaded first end and an opposing second end, the second end having an integral bolt head further including a cavity;

a lock plate;

a plurality of side plates coupled at right angles to said lock plate wherein said side plates are further coupled at right angles to the underside of the lid, whereby said lock plate is coupled to said side plates at a spaced location so as to allow a predetermined space between the opposing surfaces of said lock plate and said utility box lid;

a back plate including a first bolt aperture pivotably coupled to said plurality of side plates;

a pivot arm including a second bolt aperture pivotably coupled to said lock plate;

a threaded plate having a threaded aperture pivotably coupled to said pivot arm; and means for urging said pivot arm of said clamping mechanism in an upwardly outward direction whereby said pivot arm is caused to forcefully engage one or more inward facing vertical, horizontal or angled interior walls said utility box enclosure.

6. The lockable utility box lid of claim 5, wherein said bolt is sequentially inserted through the first bolt aperture of the back plate, the second bolt aperture of the pivot arm and rotatably inserted into the threaded aperture of the threaded plate.

7. A lockable utility box lid comprising:

a utility box lid comprising an upper surface and a lower surface and a longitudinal axis extending from a first edge to an opposing second edge thereof;

at least one clamping mechanism attached to the lower surface of the utility box lid, the clamping mechanism selectively adjustable between a first locked position and a second unlocked position; and an actuator engaging said at least one clamping mechanism for selectively adjusting the clamping mechanism between the first locked position and the second unlocked position, wherein when moving from an unlocked position to a locked position the clamping mechanism moves outwardly with respect to a center of the utility box lid, and along the longitudinal axis thereof, to engage one or more interior walls of a utility box enclosure and further wherein said actuator does not extend above the upper surface of the lid when the clamping mechanism is in the locked position or when the clamping mechanism is in the unlocked position.

8. The lockable utility box lid according to claim 7, wherein the utility box lid defines an upper aperture having a first larger end and a second smaller end, further comprising:

a lock plate fixedly attached to the lower surface of the utility box lid, the lock plate defining a lower aperture having a first larger end and a second smaller end, wherein the lock plate is oriented such that the first larger end of the upper aperture is aligned with the second smaller end of the lower aperture, and further wherein said clamping mechanism is selectively adjustable between said locked and unlocked positions by use of a tool extending through the upper aperture and the lower aperture.

9. A method of locking a utility box lid, the method comprising the steps of:

providing a utility box lid having an upper surface, a lower surface, and a longitudinal axis extending from a first edge to an opposing second edge thereof, and having a security fastener and a locking mechanism associated therewith, the security fastener comprising a head sized and shaped in a non-standard manner; and providing a tool for manipulating the security fastener, the tool having a size and shape complementary to the security fastener, wherein rotating the security fastener in a first direction causes the locking mechanism to undergo movement along the longitudinal axis of the lid and assume a first, locked position, and further wherein rotating the security fastener in a second direction causes the locking mechanism to undergo movement along the longitudinal axis of the lid and assume a second, unlocked position, and further wherein said security fastener does not extend above the upper surface of the lid when the locking mechanism is in the locked position or when the locking mechanism is in the unlocked position.

10. The method according to claim 9 wherein the locking mechanism comprises a clamp that engages an interior surface of a utility box when the locking mechanism is in the first, locked position.

* * * * *